United States Patent [19]

Ballantyne et al.

[11] 4,227,590

[45] Oct. 14, 1980

[54] GRILLE FOR LOUDSPEAKER CABINET

[75] Inventors: John R. Ballantyne, Pacific Palisades, Calif.; Axel M. Heden, deceased, late of Granada Hills, Calif., by Ingrid V. Heden, executrix

[73] Assignee: Superscope, Inc., Chatsworth, Calif.

[21] Appl. No.: 884,372

[22] Filed: Mar. 7, 1978

[51] Int. Cl.[3] ..... G10K 11/00

[52] U.S. Cl. ..... 181/175; 181/199

[58] Field of Search ..... 181/141, 155, 175, 198, 181/199, 157; 52/80, 81; 179/1 E; 312/7 R; D14/33, 34, 39; 46/28, 29

[56] References Cited

U.S. PATENT DOCUMENTS

| | | | |
|---|---|---|---|
| D. 212,004 | 8/1968 | Emond | D14/33 |
| 1,589,408 | 6/1926 | Maxfield | 181/148 |
| 2,087,901 | 7/1937 | Coots | 181/199 |
| 2,973,824 | 3/1961 | Pinski | 181/144 |
| 3,108,654 | 10/1963 | Hammes | 181/175 |
| 3,122,214 | 2/1964 | Robbins | 181/155 |
| 3,163,254 | 12/1964 | Scott | 181/175 |
| 3,494,578 | 2/1970 | Cureton | 52/81 |

*Primary Examiner*—L. T. Hix
*Assistant Examiner*—Benjamin R. Fuller
*Attorney, Agent, or Firm*—Fulwider, Patton, Rieber, Lee & Utecht

[57] ABSTRACT

For use with a cabinet containing at least one loudspeaker, a grille is provided which is comprised of elongated frame members connected by corner brackets. A rigid superstructure, comprising corner ridge members and one or more central ridge members joined by ridge joint members, is attached to the frame at the corner brackets, and a covering material is disposed over the superstructure and frame. Any size grille can be constructed using the same corner brackets and ridge joint members.

18 Claims, 14 Drawing Figures

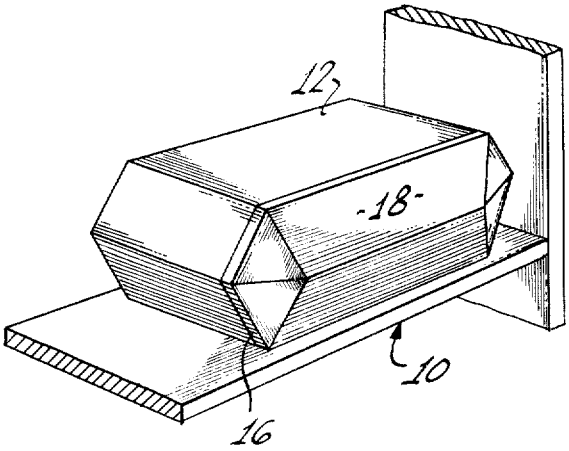
Fig. 1
Fig. 2
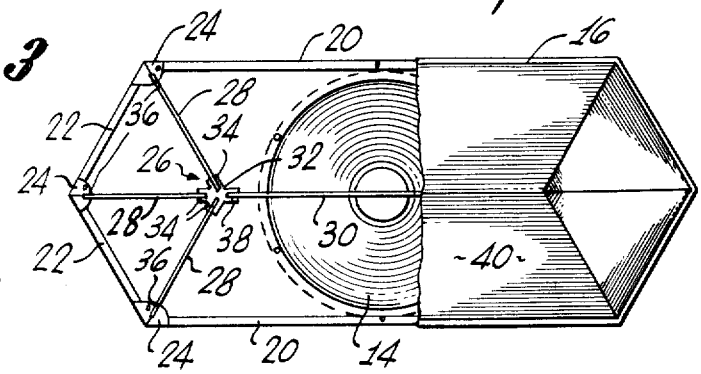
Fig. 3
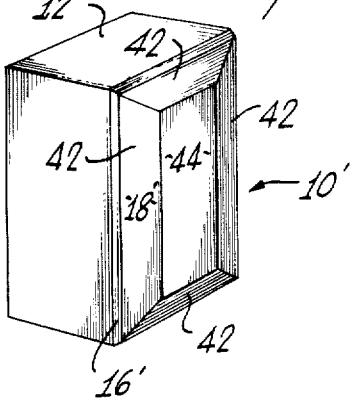
Fig. 4
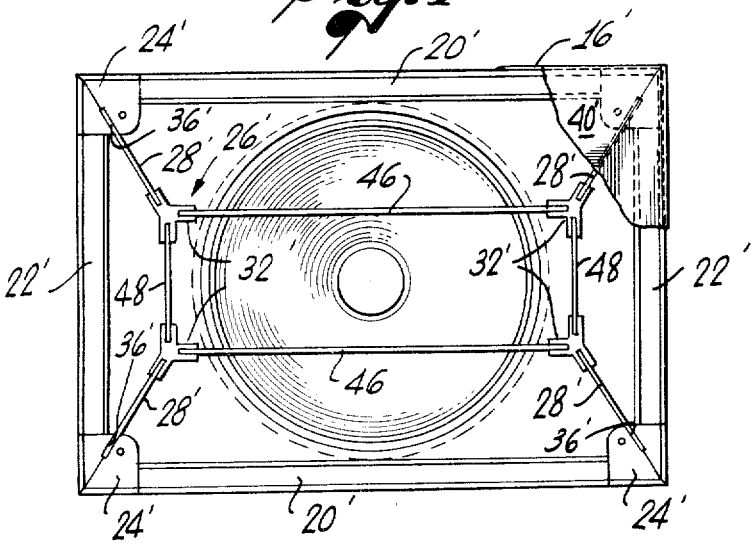

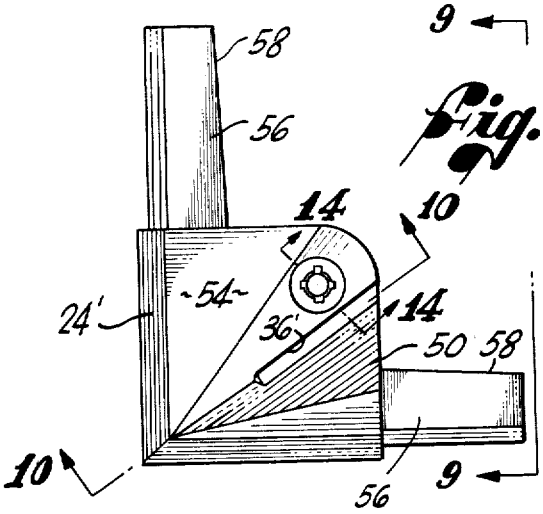
Fig. 8
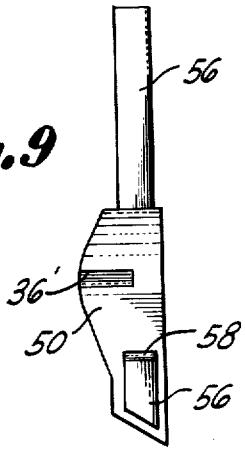
Fig. 9
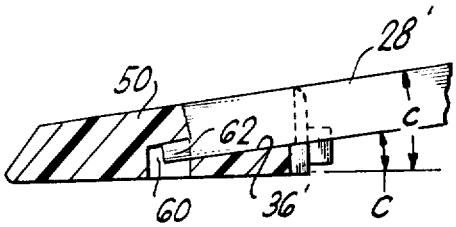
Fig. 10
Fig. 11
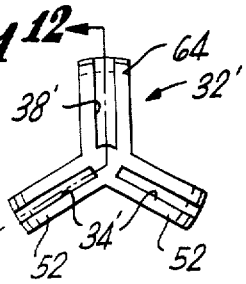
Fig. 12
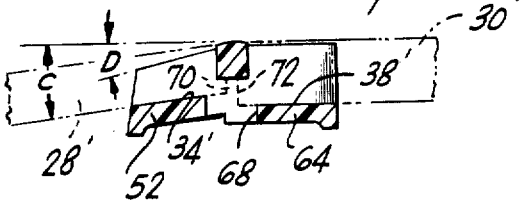
Fig. 13
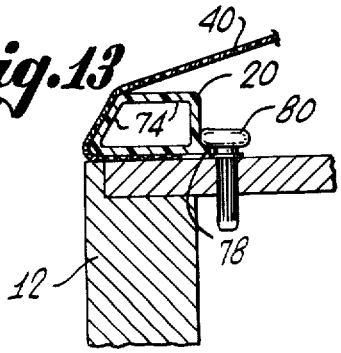
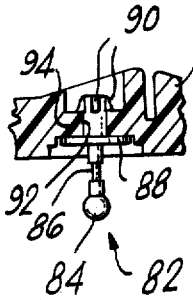
Fig. 14

GRILLE FOR LOUDSPEAKER CABINET

BACKGROUND OF THE INVENTION

This invention relates to grilles for cabinets containing one or more loudspeakers, and more particularly, to grilles for such cabinets intended for use in consumer sound systems.

Most loudspeaker cabinets are arranged to project sound from a front-facing generally planar surface and require a grille to cover and protect the loudspeakers, yet the grille must not present a significant barrier to sound emanating from the cabinet. Further, it is often desirable to form the outer surface of the grille in a non-planar fashion to enhance the aesthetic appearance of the combined cabinet and grille.

Loudspeaker cabinet grilles available heretofore typically have included a cloth material or fabric stretched over a planar frame which conforms to the shape of the front face of the cabinet and is often rectangular. This arrangement causes the loudspeakers within the cabinet to be vunerable to damage from articles of furniture, etc. which may inadvertently come in contact with the grille. Non-planar loudspeaker cabinet grilles which have been available heretofore have included a foam material secured to the frame, and the foam material is carved or cut to form the non-planar surface.

Although many loudspeaker cabinets are rectangular, the size of the rectangle varies widely according to the size and number of loudspeakers in the cabinet. Producing the numerous different sized parts required to make grilles for all of the various sizes of loudspeaker cabinets is an expensive undertaking, and this problem is compounded when the construction of the grille is complicated by forming a non-planar outer surface.

Accordingly, there has existed a need for a grille for loudspeaker cabinets which is attractive, yet provides effective protection for the loudspeakers, and is capable of being fabricated conveniently and economically in a multiplicity of sizes. The present invention satisfies that need.

SUMMARY OF THE INVENTION

The invention provides a non-planar grille construction which presents an attractive appearance and which substantially reduces the cost of producing a multiplicity of sizes of such grilles. Moreover, the grille construction of the present invention is sturdy enough to provide adequate protection of the loudspeakers, yet does not present a significant barrier to sound emanating from the cabinet.

This is accomplished generally by joining elongated frame members, all of which may be of the same tubular construction, into a generally planar polygonal frame. The frame members are joined by corner brackets, and a superstructure for forming the non-planar surface of the grille is constructed of one or more central ridge members and a plurality of corner ridge members held together by ridge joint members. The superstructure is attached to the frame at the corner brackets, and a covering material is then stretched over the superstructure and secured to the frame.

By using this construction, any size polygonal grille can be produced by simply using the required number of corner brackets and ridge joint members, and selecting various lengths of frame members and ridge members.

Other features and advantages of the present invention will become apparent from the following detailed description, taken in conjunction with the accompanying drawings, which illustrate, by way of example, the principals of the invention.

BRIEF DESCRIPTION OF THE DRAWINGS

FIG. 1 is a perspective view of a grille embodying the present invention, and is illustrated as mounted on the front of a loudspeaker cabinet having a generally hexagonal shape;

FIG. 2 is an enlarged front view of the grille embodying the present invention, and shown with part of the covering material removed to illustrate the assembly;

FIG. 3 is a perspective view of an alternative embodiment of a grille embodying the present invention, and illustrated as mounted on the front of a loudspeaker cabinet having a conventional rectangular shape;

FIG. 4 is an enlarged front view of the grille shown in FIG. 3, and shown with part of the covering material removed to illustrate the assembly;

FIG. 8 is a front view of one of the corner brackets employed in the grille of FIG. 6;

FIG. 9 is a view of the corner bracket taken substantially along line 9—9 of FIG. 8;

FIG. 10 is a partly sectional view of the corner bracket taken substantially along line 10—10 of FIG. 8 illustrated with a fragmentary corner ridge member assembled therein;

FIG. 11 is a front view of one of the ridge joint members employed in the grille of FIG. 6;

FIG. 12 is a partly sectional view of the ridge joint member taken substantially along line 12—12 of FIG. 11, and illustrated in phantom line with a fragmentary corner ridge member and a fragmentary central ridge member assembled therein;

FIG. 13 is an enlarged, fragmentary view of a frame member and locating pin, partly in cross-section, and taken substantially along line 13—13 of FIG. 6; and FIG. 14 is an enlarged, fragmentary view of a mounting pin, partly in cross-section, and taken substantially along line 14—14 of FIG. 8.

DETAILED DESCRIPTION

Figure 5:
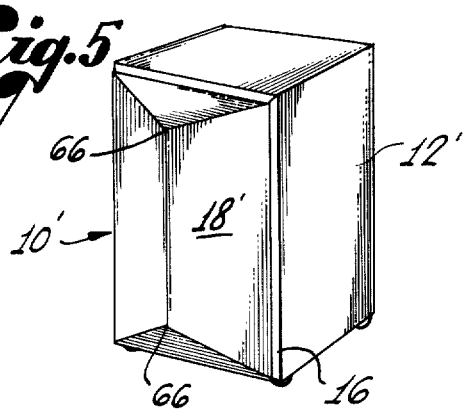
FIG. 5 is a perspective view of another alternative embodiment of a grille embodying the present invention, and illustrated as mounted on the front of a loudspeaker cabinet having a conventional rectangular shape.
Figure 7:
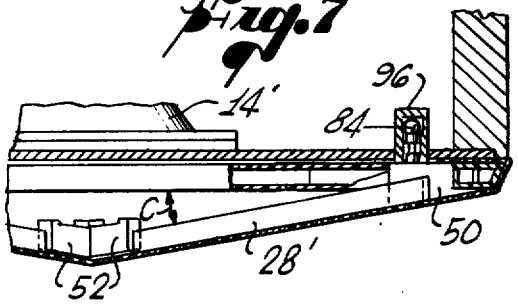
FIG. 7 is a fragmentary view of the grille taken substantially along line 7—7 of FIG. 6.

As shown in the exemplary drawings, the present invention is embodied in a new and improved grille, indicated generally by reference numeral 10 in FIG. 1, for use with a cabinet 12 containing one or more loudspeakers 14 (FIG. 2). The grille 10 is of the type having a generally planar frame 16 which conforms with the generally hexagonal shape of the front of the cabinet 12, and having a non-planar outer surface 18.

The grille 10 is mounted on the front of the cabinet 12, and is the surface through which sound emanates from the loudspeakers inside the cabinet. The grille 10 is readily permeable to sound, and covers that portion of the cabinet through which the loudspeakers are most vunerable to damage.

In accordance with the present invention, the grille 10 is provided with an attractive non-planar surface 18, yet provides effective protection for the loudspeakers in the cabinet 12. Further, the grille 10 is capable of being conveniently and economically fabricated in a multiplicity of sizes.

Toward the foregoing ends, the frame 16 is constructed of two elongated side frame members 20 of substantially equal length, and four elongated end frame members 22 also of substantially equal length, although generally shorter than the side frame members 20. The side and end frame members 20 and 22 are joined at 120° angles by six corner brackets 24.

The frame members 20 and 22 are preferably of the same tubular construction, and may be secured to the corner brackets 24 by fitting over projections from the corner brackets 24 as will be discussed in greater detail hereinafter. By using this construction, any size hexagonal frame 16 may be produced by selecting two side frame members 20 and four end frame members 22 of the desired lengths and joining them with six corner brackets 24, and a regular hexagonal frame 16 may be produced by selecting both side frame members 20 and end frame members 22 of the same length.

A superstructure, indicated generally by reference numeral 26, is constructed of six corner ridge members 28, a central ridge member 30 and two ridge joint members 32. The superstructure 26 is constructed upon the frame 16 such that the central ridge member 30 is spaced from the plane of the hexagonal frame 16 and disposed generally parallel to the longitudinal axis of the frame 16. Each end of the central ridge member 30 is supported by three corner ridge members 28. The corner ridge members 28 are secured to the end of the central ridge member 30 by a ridge joint member 32. One end of each corner ridge member 28 is received in a slot 34 in the ridge joint member 32, and the other end of the corner ridge member 28 is received in a slot 36 in the corner bracket 24. The central ridge member 30 is secured in a slot 38 in the ridge joint member 32.

As viewed in FIG. 2, the slots 36 are each arranged in a direction which bisects the 120° angle formed by the corner bracket 24, and the slots 34 are arranged at 60° angles with respect to each other in order to cooperate in a straight line relationship with the slots 36. In order to support the central ridge member 30 in a spaced relation from and parallel to the plane of the hexagonal frame 16, the corner ridge members 28 are inclined at an acute angle with respect to the plane of the frame 16, and the slots 34 and 36 are arranged to accomodate the angularity of the corner ridge members 28 as will be described in greater detail hereinafter.

The superstructure 26 may be constructed upon any size frame 16 by selecting the desired lengths of corner ridge members 28 and the central ridge member 30. The ridge members 28 and 30 may then be assembled with the ridge joint members 32 to form the superstructure 26 which may then be mounted upon the corner brackets 24.

A covering material or fabric 40 is disposed over the superstructure 26 and secured to the frame 16 by any suitable means. The covering material 40 must be readily permeable to sound and must be capable of retaining a neat appearance conforming to the shape defined by the superstructure 26 and frame 16 for an extended period of time. Toward these ends, the fabric 40 is preferably a knitted polyester fiber. Further, the fabric 40 may be stretched over the superstructure 26 and secured to the back of the frame 16 by an adhesive.

An alternative embodiment of the present invention is illustrated in exemplary FIGS. 3 and 4. In this instance, the grille 10' is also of the non-planar type similar to that previously discussed in connection with the grille of FIGS. 1 and 2, and parts of the grille of FIGS. 3 and 4, which find substantial correspondence in structure and function to those previously discussed in connection with FIGS. 1 and 2, have been designated with corresponding primed referenced numerals.

The grille 10' is mounted on the front of a cabinet 12' and includes a generally planar frame 16' which conforms with the shape of the cabinet, which in this instance is rectangular. The grille 10' has a non-planar outer surface 18' which includes four generally trapezoidal inclined surfaces 42 and a rectangular surface 44 which is spaced from and generally parallel to the plane of the frame 16'.

The frame 16' is constructed of two elongated side frame members 20' of substantially equal length, and two elongated end frame members 22' also of substantially equal length, although generally shorter than the side frame members 20'. The side and end frame members 20' and 22' are joined at 90° angles by four corner brackets 24'. By using this construction, any size rectangular frame 16' may be produced by selecting two side frame members 20' and two end frame members 22' of the desired lengths and joining them with four corner brackets 24'. A square frame 16' may be produced by selecting side frame members 20' and end frame members 22' all of the same length.

The superstructure, indicated generally by reference numeral 26', is constructed by four corner ridge members 28', each of which is received at one end in a slot 36' in the corner brackets 24', and at its other end supports one corner of a generally rectangular ridge structure including two longitudinal ridge members 46 and two transverse ridge members 48 which are connected to each other and to the corner ridge members by four ridge joint members 32'. Each ridge joint member 32' is arranged with two slots at 90° angles for receiving the longitudinal and transverse ridge members 46 and 48 and a third slot for receiving the upper end of a corner ridge member 28'.

The superstructure 26' may be constructed upon any size frame 16' by selecting the desired length of corner ridge members 28', longitudinal ridge members 46 and transverse ridge members 48. The ridge members 28', 46 and 48 may then be assembled with the ridge joint members 32' to form the superstructure 26' which may then be mounted upon the corner brackets 24'.

A covering material 40' is disposed over the superstructure 26' and secured to the frame 16' by any suitable means. The covering material forms the trapezoidal and rectangular surfaces 42 and 44, and each of the ridge members lies at the apex of a dihedral angle thereby forming the non-planar surface 18'.

Another alternative embodiment of the present invention is illustrated in exemplary FIGS. 5 through 12, and as discussed connection with FIGS. 3 and 4 above, parts of the grille of FIGS. 5 through 12, which find substantial correspondence in structure and function to those previously discussed in connection with FIGS. 1 and 2, have been designated with corresponding primed reference numerals.

The grille 10' is mounted on the front of a generally rectangular cabinet 12' and is comprised of a rectangular frame 16' and a non-planar outer surface 18'. The frame 16' is constructed of two side frame members 20', two end frame members 22' and four corner brackets 24' in the same manner as described in connection with the embodiment of FIGS. 3 and 4 above.

A superstructure, indicated generally by reference numeral 26' is constructed of four corner ridge members 28', a central ridge member 30' and two ridge joint members 32'. The superstructure 26' is constructed upon the frame 16' such that the central ridge member 30' is spaced from the plane of the rectangular frame 16' and disposed generally parallel to the longitudinal axis of the rectangular frame 16'. Each end of the central ridge member 30' is supported by two corner ridge members 28' which are secured to the end of the central ridge member 30' by a ridge joint member 32'. One end of each corner ridge member 28' is received in a slot 34' in the ridge joint member 32', and the other end of the corner ridge member 28' is received in a slot 36' in the corner bracket 24'. The central ridge member 30' is secured in a slot 38' in the ridge joint member 32'.

Figure 6:
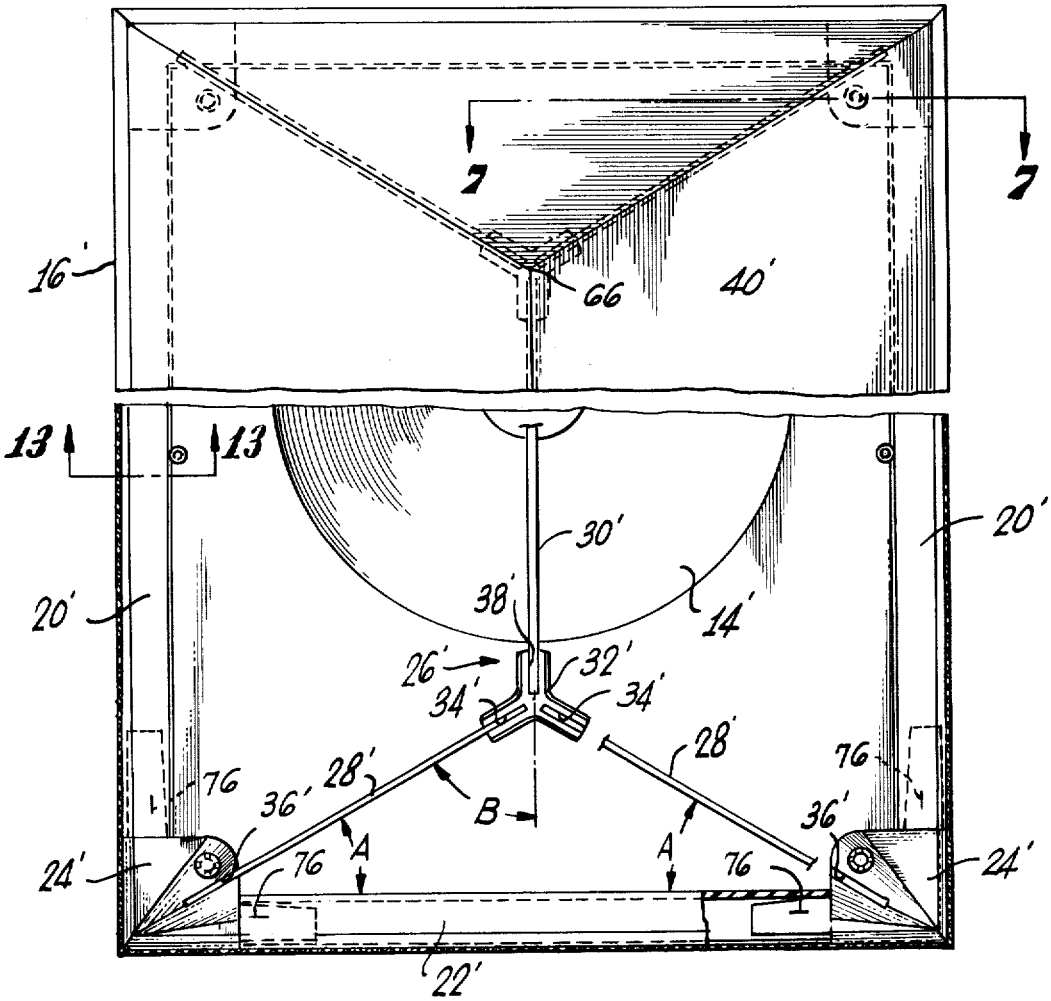
FIG. 6 is an enlarged front view of the grille shown in FIG. 5, and illustrated with part of the covering material removed and some members of the frame and superstructure broken away to illustrate the assembly.

As viewed in FIG. 6, the slots 36' are each arranged in a direction which forms an angle A with respect to the end frame member 22', and the slots 34' are inclined at an angle B with respect to an extention of the central ridge member 30'. Angles A and B are complementary angles. As can best be seen in FIG. 7, the corner ridge members 28' are inclined at an angle C with respect to the plane of the frame 16'. A raised portion 50 of the corner bracket 24' and an extending portion 52 of the ridge joint member 32' are similarly inclined to receive the corner ridge member 28' in a straight line relationship.

As in the embodiments illustrated in exemplary FIGS. 1 through 4, a superstructure 26' may be constructed upon any size frame 16' by selecting the desired lengths of corner ridge members 28' and the central ridge member 30'. The ridge members 28' and 30' may then be assembled with the ridge joint members 32' to form the superstructure 26' which may then be mounted upon the corner brackets 24'. A covering material 40' is disposed over the superstructure 26' and secured to the frame 16' thereby forming the non-planar surface 18'.

As can best be seen in FIGS. 8, 9, and 10, the presently preferred embodiment of the corner brackets 24' is comprised of a body portion 54 from which two projections 56 extend forming a 90° angle. The projections 56 are arranged to be slidably received within the tubular frame members for attaching the frame members to the corner brackets. The slot 36' is formed in the raised portion 50 of the body portion 54. In order to receive the corner ridge member 28' in a straight line relationship, the top of the raised portion 50 and the bottom of the slot 36 are each inclined at the angle C with respect to the plane of the frame 16'. The body portion 54 of the corner bracket has an aperture 60 in the bottom thereof which communicates with the inner end of the slot 36' for receiving a lug 62 projecting from the end of the corner ridge member 28'. By this arrangement, the corner ridge member 28' may be securely fixed to the corner bracket, if desired, without use of any adhesive.

As can best be seen in FIG. 9, the end view configuration or profile of the projections 56 is preferably shaped to conform with the shape defined by the inner walls of the tubular frame members 20' and 22'. Further, one side of the projections 56 may be tapered as at 58 for facilitating the assembly of the projections 56 into the tubular frame members 20' and 22'. The construction of the frame members 20' and 22' and the purpose of the taper 58 will be discussed in more detail later.

The ridge joint member 32' is comprised of two extending portions 52 for receiving one end of a corner ridge member 28', and a central portion 64 for receiving one end of the central ridge member 30'. For this purpose, one of the slots 34' is formed in each extending portion 52, and the slot 38' is formed in the central portion 64.

The bottom of each slot 34' is inclined downwardly from the horizontal at the angle C. However, the top of the extending portion 52 is inclined downwardly from the horizontal at an angle D which is greater than the angle C. This structure is provided so that when the corner ridge member 28' is secured into the slot 34' and the fabric 40' is stretched over the superstructure 26', the material will bear only on the corner ridge member 28', and not on the top of the extending portion 52. Similarly, the top of the central portion 64 is below the top of central ridge member 30' so that the fabric 40' will bear only upon the central ridge member 30', and not on the top of the central portion 64. In this way, as can be seen for example in FIG. 5, the contour of the ridge joint member 32' can not be seen from the front of the grille 10', and a neat and attractive trihedral angle 66 is formed at the juncture of the corner ridge members 28' and the central ridge member 30'.

The ridge joint member 32' may be provided with an aperture 68 in the bottom thereof which communicates with the slots 34' and the slot 38' for receiving a lug 70 projecting from the upper end of the corner ridge member 28' and a lug 72 projecting from the end of the central ridge member 30'. As in the corner bracket described above, this arrangement allows the ridge members 28' and 30' to be securely fixed to the ridge joint member 32', if desired, without use of any adhesive.

The frame members 20 and 22 are preferably of the same tubular construction. In this way, the frame members 20 and 22 may be cut to the required lengths from a single standard extrusion for forming a frame 16 of any desired size.

The frame members 20 and 22 may be of any desired external configuration, and the inner walls 74 (FIG. 13) of the frame members 20 and 22 define a shape that is similar to the above mentioned profile of the projections 56 from the corner brackets 24. In this context, similar is used in the geometrical sense of having the same angles and ratio of lengths of sides. The sizes of the similar shapes defined by the inner walls 74 of the frame members 20 and 22 and the profile of the projections 56 are arranged so that the projections 56 are slidably received in the space defined by the inner walls 74 of the frame members 20 and 22 and fit tightly therein.

In forming the frame members 20 and 22 so that the projections 56 fit tightly, it occasionally becomes difficult to manually insert the projections 56 into the frame members 20 and 22. Accordingly, it has been found useful to provide the projections 56 with the taper 58 for facilitating the assembly of the projections 56 into the frame members 20 and 22. During assembly, the distal end of the projection 56 is inserted into the end of a frame member and pushed in until the end of the frame member contacts the body portion 54 of the corner bracket. The frame member may be held in position by any securing means such as a staple 76 (FIG. 6), or, if desired, by any suitable adhesive.

The side frame member 20 occasionally tends to bend inwardly under the load of the covering material 40 which has been stretched over the frame 16 and superstructure 26 and adhered to the frame members 20 and 22. The tendency of the side frame member to bend increases as the size of the grille 10 increases. In order to prevent this undesirable bending, the frame members 20 and 22 are provided with a locating ridge 78 which projects from the side of the frame members 20 and 22 facing the center of the grille 10. As can best be seen in FIGS. 6 and 13, the ridge 78 on the side frame member 20 fits under the head of a locating pin 80 which is mounted in the front of the cabinet 12. Any number of locating pins 80 may be used wherever necessary to prevent the undesirable bending of the frame members 20 and 22.

In order to mount the grille 10 on the cabinet 12, each corner bracket 24 as seen in FIG. 14, may include a mounting pin 82 which may include a ball portion 84, a shank or shaft 86, a shoulder 88 and one or more retaining projections 90. The mounting pin 82 may be secured to the corner bracket 24 by being inserted through an aperture 92 in a wall 94 of the corner bracket 24. The shoulder 88 contacts one side of the wall 94, and retaining projections 90 emerge from the aperture 92 and bear against the other side of the wall 94 thereby holding the mounting pin 82 firmly in place. Each ball portion 84 of the mounting pins 82 may be received in a socket 96 (FIG. 7) formed in cabinet 12, thereby releasably mounting the grille 10 on the cabinet 12.

The corner ridge members 28 and the central ridge member 30 may be formed of any rigid material, standard steel bar being the preferred material. The corner brackets 24, ridge joint members 32 and frame members 20 and 22 may be fabricated conveniently and economically from moldable or extrudable plastic materials.

When the grille 10 is assembled as previously discussed in connection with FIGS. 10 and 12, the structure forms a flexible, easily handled grille which is sufficiently rigid to provide protection of the loudspeakers in the cabinet, and any play which may exist between the ridge members and the corner brackets or ridge joint members is removed by the tension in the covering material 40 which is stretched over the superstructure 26 and secured to the frame 16. If additional rigidity is desired after the grille 10 has been assembled, any suitable adhesive can be introduced into the corner bracket and ridge joint members through the apertures 60 and 68 respectively.

From the foregoing, it will be appreciated that the grille 10 presents an attractive, non-planar appearance and also provides a rigid superstructure 26 for the protection of the loudspeakers inside the cabinet 12. Further, the grille 10 can be fabricated conveniently and economically by selecting the desired lengths of frame members 20 and 22 and ridge members 28 and 30, and assembling them with the required number of corner brackets 24 and ridge joint members 32. The same size corner brackets 24 and ridge joint members 32 may be used in fabricating any size grille 10, and various polygonal grilles may be constructed by providing corner brackets having different angles between the projections 56, and ridge joint members having the required number of extending portions 52.

While several particular forms of the invention have been illustrated and described, it will also be apparent that various modifications can be made without departing from the spirit and scope of the invention.

We claim:

1. The combination of a cabinet containing at least one loudspeaker and a non-planer grille mounted on said cabinet for permitting sound to emanate from said cabinet through said grille, said grille comprising:

a substantially planar polygonal frame including means for securing said frame to a substantially planar face of said cabinet, said frame having a size and shape corresponding to the size and shape of said face of said cabinet, said frame comprising an equal number of elongated frame members and corner brackets, each corner bracket joining two frame members at a predetermined angle, said frame members being substantially tubular and being joined to said corner brackets by fitting over projections on said corner brackets;

a ridge structure disposed upon said frame and comprised of a plurality of elongated ridge members which intersect at at least one point outside of the plane of said frame, said ridge structure comprising a number of corner ridge members equal to the number of frame members, each corner ridge member having one end secured to a corner bracket and the other end secured to a ridge joint member at a point outside of the plane of said frame; and a covering material disposed over said structure and secured to said frame.

2. A combination as defined in claim 1 wherein said material is stretched over said ridge structure and frame and said cabinet includes a locating pin arranged to cooperate with a locating ridge on at least one of said frame members for retaining said frame member in position against the force of said stretched material.

3. A combination as defined in claim 1 wherein each of said projections is tapered to be narrower at its distal end to facilitate its insertion into said frame members.

4. A combination as defined in said claim 1 wherein said polygonal frame is substantially elongated and wherein two of said corner ridge members support a central ridge member in a position spaced from the plane of said frame and substantially parallel to the longitudinal axis of said frame.

5. A combination as defined in claim 4 wherein said frame is hexagonal.

6. A combination as defined in claim 4 wherein said frame is rectangular.

7. A combination as defined in claim 4 wherein said corner ridge members and said central ridge members are each received in a slot in a ridge joint member, said slots having a recess at their inner ends for cooperating with a lug projecting from the end of each of said ridge members thereby securely retaining said ridge members within said slots.

8. A combination as defined in claim 1 wherein a number of ridge joint members equal to the number of corner brackets support the same number of ridge members forming an elevated surface which is similar to and smaller than said polygonal frame, said elevated surface being spaced from and generally parallel to the plane of said frame.

9. A combination as defined in claim 8 wherein said frame is rectangular.

10. A combination as defined in claim 8 wherein each ridge joint member has a first slot for receiving one end of a corner ridge member and two additional slots for receiving two of said ridge members forming said elevated surface, each of said slots having a recess at its inner end for cooperating with a lug projecting from the end of each of said ridge members thereby securely retaining said ridge members within said slots.

11. A combination as defined in claim 1 wherein each of said corner brackets has a slot for receiving a corner ridge member, and said slot has a recess at its inner end for cooperating with a lug projecting from the end of said corner ridge member thereby securely retaining said corner ridge member within said slot.

12. The combination of a cabinet containing at least one loudspeaker, and a non-planar grille mounted on said cabinet for permitting sound to emanate from said cabinet through said grille; said grille comprising:

a pair of elongated side frame members;

a pair of elongated end frame members;

four corner brackets, arranged to join said side and end frame members at 90° angles, said frame members being substantially tubular and being joined to said corner brackets by fitting over projections on said corner brackets, thereby forming a substantially planar rectangular frame including means for securing said frame to a substantially planar rectangular face of said cabinet, said frame being sized to substantially correspond with the size of said face of said cabinet;

an elongated central ridge member spaced from said plane and disposed in a parallel relationship with the longitudinal axis of said rectangle, and extending from a first point near a first end of said rectangle, to a second point near a second end of said rectangle, said central ridge member being supported at said first point by a pair of corner ridge members extending from said first point to said corner brackets at said first end of said rectangle, and supported at said second point by a pair of corner ridge members extending from said second point to said corner brackets at said second end of said rectangle, each end of said central ridge member being joined with said corner ridge members by a ridge joint member; and a permeable covering material disposed over said central and corner ridge members and secured to said frame members thereby forming said non-planar grille.

13. A combination as defined in claim 12 wherein each of said corner brackets includes a means for releasably attaching said grille to said cabinet.

14. A combination as defined in claim 12 wherein said permeable covering material is knitted polyester fiber, and said material is stretched over said central and corner ridge members and secured to said frame members by an adhesive.

15. A combination as defined in claim 14 wherein said cabinet includes a locating pin arranged to cooperate with a locating ridge on said side frame members for retaining said side frame member in position against the force of said stretched material.

16. A combination as defined in claim 12 wherein each of said projections is tapered to be narrower at its distal end to facilitate insertion into said frame members.

17. A combination as defined in claim 12 wherein each of said corner brackets has a slot for receiving a corner ridge member, and said slot has a recess at its inner end for cooperating with a lug projecting from the end of said corner ridge member thereby securely retaining said corner ridge member within said slot.

18. A combination as defined in claim 12 wherein said corner ridge members and said central ridge members are each received in a slot in a ridge joint member, said slots having a recess at their inner ends for cooperating with a lug projecting from the end of each of said ridge members thereby securely retaining said ridge members within said slots.

* * * * *